US006583546B2

(12) United States Patent
Nah

(10) Patent No.: US 6,583,546 B2
(45) Date of Patent: Jun. 24, 2003

(54) COLOR CATHODE RAY TUBE

(75) Inventor: Keon Soo Nah, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 35 days.

(21) Appl. No.: 09/826,873

(22) Filed: Apr. 6, 2001

(65) Prior Publication Data

US 2001/0045796 A1 Nov. 29, 2001

(30) Foreign Application Priority Data

Apr. 29, 2000 (KR) ..... 2000-23093

(51) Int. Cl.[7] ..... H01J 29/80
(52) U.S. Cl. ..... 313/407
(58) Field of Search ..... 313/477 R

(56) References Cited

U.S. PATENT DOCUMENTS 5,925,977 A * 7/1999 Sugawara et al. ..... 220/2.1 A

* cited by examiner

*Primary Examiner*—Sandra O'Shea
*Assistant Examiner*—Sumati Krishnan
(74) *Attorney, Agent, or Firm*—Fleshner & Kim, LLP

(57) ABSTRACT

Color cathode ray tube including a panel having a substantially flat outside surface and an inside surface with a curvature, and a shadow mask at rear of the panel formed to have a curvature, wherein, when Rxp denotes a radius of curvature of the inside surface of the panel in a long axis direction, Ryp denotes a radius of curvature of the inside surface of the panel in a short axis direction, Rdm denotes a radius of curvature of the shadow mask in a diagonal axis direction, and 'W' denotes a ratio of a thickness of an end portion of an effective surface of the panel to a thickness of a center portion of the panel, the radius Rxp of curvature of the inside surface of the panel in the long axis direction, and the radius Ryp of curvature of the inside surface of the panel in the short axis direction can be respectively expressed as follows;

$$R_{xp}=(A\cdot W+B)\cdot R_{dm}(A=-0.217,\ 1.607<B<2.446)$$

$$R_{yp}=(C\cdot W+D)\cdot R_{dm}(C=-0.074,\ 0.799<D<1.227),$$

thereby improving structural strength.

6 Claims, 5 Drawing Sheets

COLOR CATHODE RAY TUBE

BACKGROUND OF THE INVENTION

1. Field of the Invention

The present invention relates to a color cathode ray tube, and more particularly, to a panel and a shadow mask in a color cathode ray tube having a curvature and a radius of curvature required for displaying a picture.

2. Background of the Related Art

In general, the cathode ray tube is a major component for displaying the picture in displays, such as TV receiver, or a computer monitor. FIG. 1 illustrates a side view with a partial cut away view of the color cathode ray tube.

Referring to FIG. 1, there is a fluorescent film 1*a* having red, green, and blue fluorescent materials on an inside surface of a panel 1, a funnel 2 at rear of the panel 1 welded thereto with Frit glass, and an electron gun 4 in a neck portion 2*a* of the funnel. There is a shadow mask 5 fitted to the frame 6 for selecting colors of the electron beams 3 from the electron gun 4. The frame 6 is inserted in stud pins 1*b* fixed to sidewalls of the panel 1 by means of supporting springs 8 fixed to the frame 6, hanging from the sidewalls of the panel 1. There is an inner shield 7 fitted to one side of the frame 6 for protecting the electron beams 3 traveling toward the fluorescent film 1*a* from external geomagnetism. There is a deflection yoke 10 having a plurality of poles fitted to an outer circumference of the neck portion 2*a* for correcting a path of travel of the electron beams 3 to hit onto a required fluorescent material accurately, and a reinforcing band 9 strapped around the cathode ray tube for preventing the cathode ray tube suffering from damage by an external impact. Within a basic structure of the cathode ray tube, the panel 1 and the shadow mask 5 form an assembly having a required geometrical relation to each other. That is, the shadow mask 5 is formed to have a curvature required with respect to a curvature of the panel 1, and fitted to have a gap required with respect to the panel 1, so that the three electron beams from the electron gun 4 hit onto the fluorescent material on the inside surface of the panel 1 through the shadow mask 5 to reproduce a picture. Therefore, in order to reproduce a high quality picture, an accurate design of the shadow mask 6 is required, taking an inside surface curvature of the panel 1 into account at first as a condition of the design. FIG. 2 illustrates a section of a panel assembly, referring to which a relation between the inside surface curvature of the panel and the curvature of the shadow mask will be explained.

Referring to FIG. 2, the panel 1 has curved inside and curved outside surfaces, wherein a radius Rop of curvature of the outside curved surface of the panel 1 and a radius Rip of curvature of the inside curved surface of the panel 1 are formed to have a Rop>Rip relation so that the panel 1 can withstand a vacuum inside of the cathode ray tube. As radiuses Rop and Rip of the curvatures are inversely proportional to the curvatures, the curvature of the inside curved surface of the panel 1 is greater than the curvature of the outside curved surface of the panel 1. Since geometrical characteristics of the panel 1 and the shadow mask 5 are required to be the same for displaying the picture in fact, the curvature of the inside surface of the panel 1 is taken into account as an element that fixes the curvature of the shadow mask 5, which curvature of the shadow mask 5 has close relation with a structural strength and thermal deformation characteristic of the shadow mask 5. That is, the greater the curvature of the shadow mask 5, the more the structural strength and the thermal deformation characteristic improved.

In addition to the relation between the curvatures and the radiuses of the curvatures, as shown in FIG. 2, there are an arc curvature shown in a solid line and a super arc curvature shown in a dashed line in forms of the curvatures applicable to the inside surface of the panel 1 and the shadow mask 5. The arc curvature is one a portion of a sphere is applied thereto, and the super arc curvature is one in which a curvature becomes the greater as it goes the farther to outside. These forms of curvatures are applicable to the inside surface of the panel 1 selectively, according to which the shadow mask 5 also has either the arc curvature or the super arc curvature. As shown in FIG. 2, since the super arc curvature has height variation of the shadow mask 5 relatively smaller than the arc curvature, the super arc curvature is favorable to thermal deformation. Though the arc curvature and the super arc curvature have been applied to the panel 1 and the shadow mask 5 without particular preference, the super arc curvature is used widely when the thermal deformation is taken into account. Moreover, since curvatures of, not only the panel 1, but also the shadow mask 5, are designed large adequately in view of structural strength, no particular attention is paid thereto. However, recently panel 1 has the radius Rop of curvature of outside surface fully planar or greater than 40,000 mm close to a perfect plane for improving a picture quality, according to which the radius Rip of curvature of inside surface of the panel 1, dependent on the radius Rop of curvature of outside surface of the panel 1, is also increased, and the radius of curvature of the shadow mask 5, dependent on the radius Rip of curvature of the inside surface, is also increased. In other words, according to the inversely proportional relationship between the curvature and the radius of curvature, the curvature of inside surface of the panel 1 and the curvature of the shadow mask 5 are reduced, respectively.

As explained, the reduced curvature of the shadow mask 5 makes the structural strength and thermal deformation of the shadow mask 5 poor. Particularly, the poor structural strength causes howling, shaking of picture by impact or speaker sound, and defective color reproducibility, a variation of picture color, as well as deformation of the shadow mask 5 by external impact or load. Currently, since the problem of thermal deformation is resolved by means of, not the curvature of the shadow mask 5 or similar to this, but reflecting the thermal electron at a reflective film (not shown) coated on a surface of collision of the electron beams 3, a method for improving the structural strength of the shadow mask 5 is required.

SUMMARY OF THE INVENTION

Accordingly, the present invention is directed to a color cathode ray tube that substantially obviates one or more of the problems due to limitations and disadvantages of the related art.

An object of the present invention is to provide a color cathode ray tube having a shadow mask of improved structural strength.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the color cathode ray tube includes a panel having a substantially flat outside surface and an inside surface with a curvature, and a shadow mask at rear of the panel formed to have a curvature, wherein, when Rxp denotes a radius of curvature of the inside surface of the panel in a long axis direction, Ryp denotes a radius of curvature of the inside surface of the panel in a short axis direction, Rdm denotes a radius of curvature of the shadow mask in a diagonal axis direction, and 'W' denotes a ratio of a thickness of an end portion of an effective surface of the panel to a thickness of a center portion of the panel, the radius Rxp of curvature of the inside surface of the panel in the long axis direction, and the radius Ryp of curvature of the inside surface of the panel in the short axis direction can be respectively expressed as follows;

$$R_{xp}=(A\cdot W+B)\cdot R_{dm}(A=-0.217,\ 1.607<B<2.446)$$

$$R_{yp}=(C\cdot W+D)\cdot R_{dm}(C=-0.074,\ 0.799<D<1.227).$$

When Rdp denotes the radius of curvature of the inside surface of the panel in the diagonal axis direction, the Rdp can be expressed as follows, $$R_{dp}=\frac{(4\cdot R_{xp}+3\cdot R_{yp})}{(E\cdot W+F)}(E=0.011,\ F=6.655).$$

It is preferable that the ratio of a thickness of an end portion of an effective surface of the panel to a thickness of a center portion of the panel 'W' falls within a range of 1.4<W<2.5.

When Ldme denotes a distance from a center of the shadow mask to an end of the effective surface of the shadow mask in the diagonal axis direction, and Hdme denotes a height at the end of the shadow mask in the diagonal axis direction, the radius of curvature Rdm of the shadow mask in the diagonal axis direction can be expressed as follows.

$$R_{\mathrm{dm}}=\frac{L_{dme}^2+H_{dme}^2}{2H_{dme}}.$$

When Xm denotes a coordinate on the long axis of the shadow mask, Ym denotes a coordinate on the short axis of the shadow mask, and Zm denotes a coordinate on a height axis of the shadow mask, the curvature of the shadow mask can be expressed as follows.

$$Z_m=R_{dm}-\sqrt{R_{dm}^2-(X_m^2+Y_m^2)}.$$

When 'α' denotes a dispersion come from a fabrication process and a deflection yoke, a curvature structure of the shadow mask can be expressed as follows, taking the dispersion into account.

$$Z_m=R_{dm}-\sqrt{R_{dm}^2-(X_m^2+Y_m^2)}\pm\alpha,$$

$$\text{where, }\alpha=\frac{\sqrt{X_m^2+Y_m^2}\times\left(L_{dme}-\sqrt{X_m^2+Y_m^2}\right)}{44.456L_{dme}}.$$

The curvature structure of the present invention substantially enhances a structural strength of the shadow mask, which prevents deterioration of a color reproducibility caused by vibration and deformation of the shadow mask caused by an external impact.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In the explanation of the present invention, same components will be given the same names and reference symbols, and of which additional explanations will be omitted.

Figure 1:
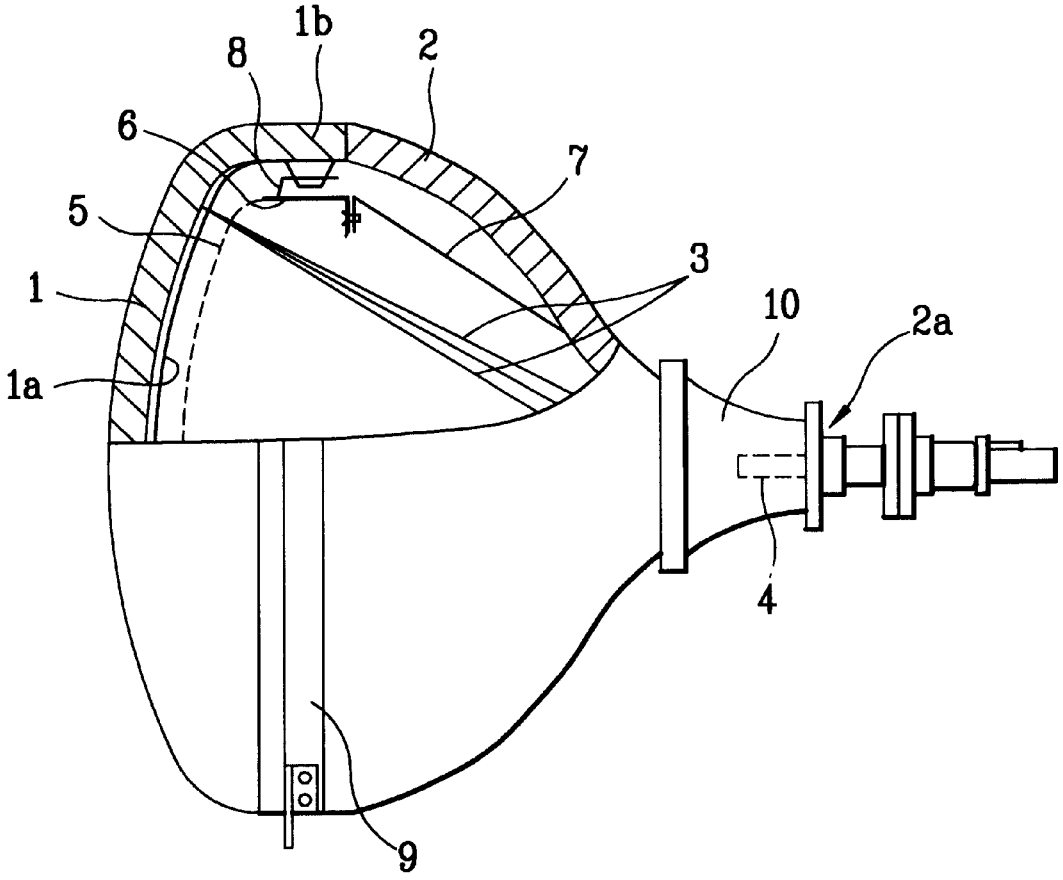
FIG.1 Related Art
FIG. 1 illustrates a side view with a partial cut away view of a color cathode ray tube.
Figure 2:
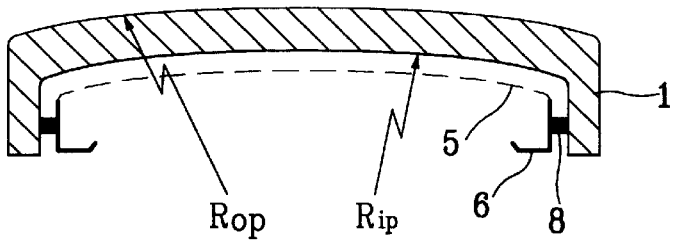
FIG.2 Related Art
FIG. 2 illustrates a section of a panel assembly in a color cathode ray tube.
Figure 3:
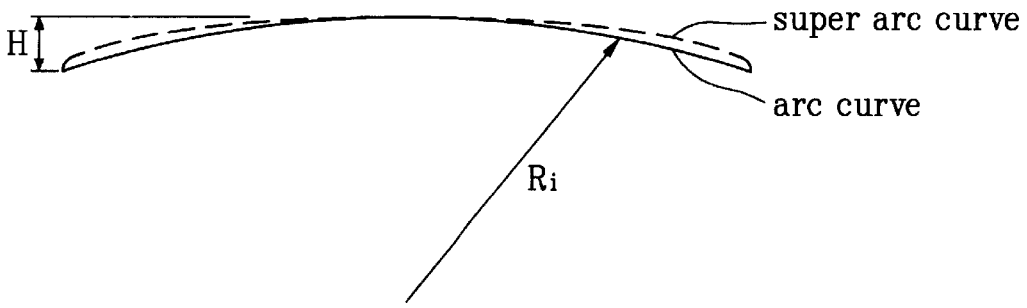
FIG.3 Related Art
FIG. 3 illustrates a comparison of an arc curvature and a super arc curvature, schematically.
Figure 4:
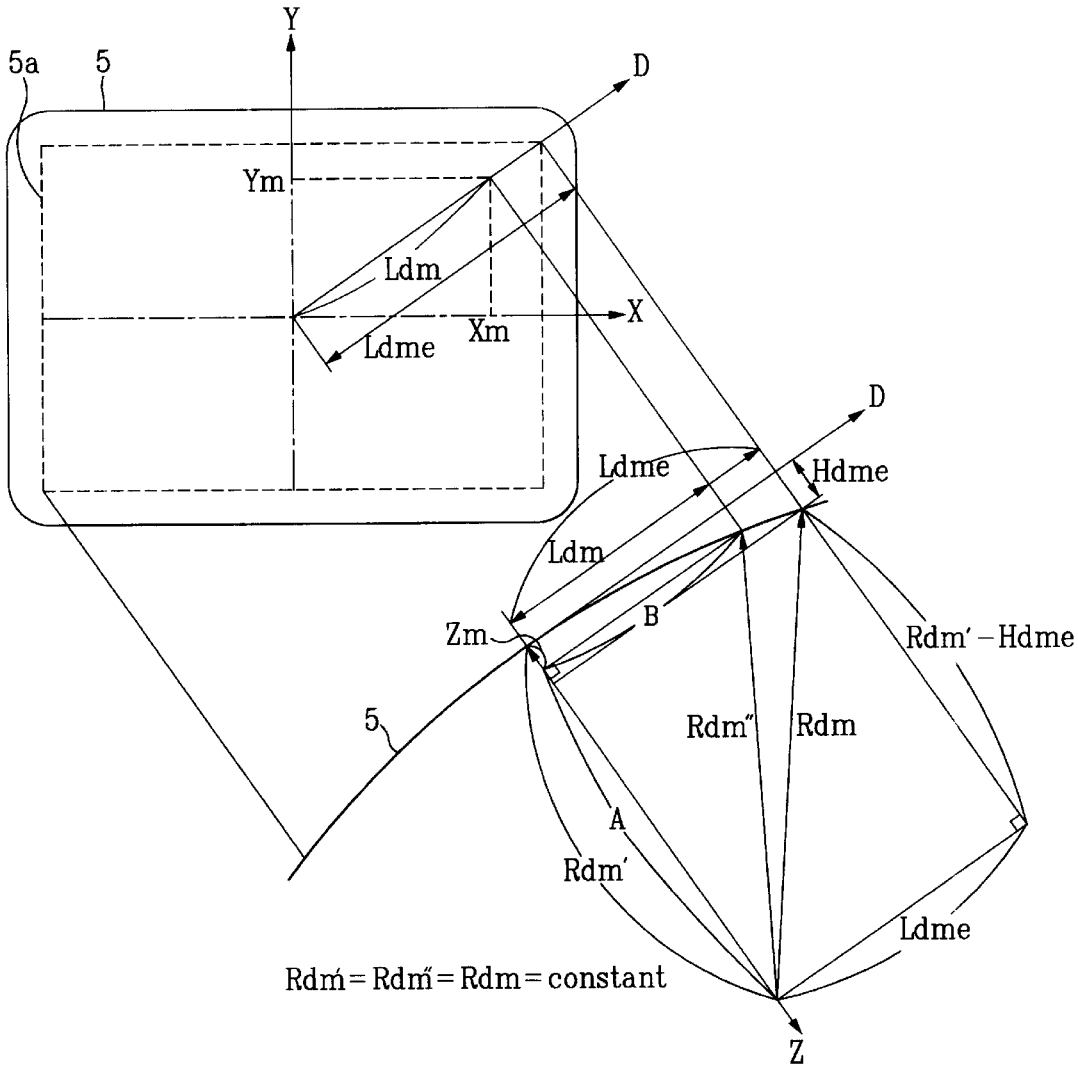
FIG. 4 illustrates a curvature structure of a shadow mask in accordance with a preferred embodiment of the present invention shown with reference to a diagonal axis, schematically.

Different from the related art in which a curvature of the shadow mask 5 is designed after curvatures of inside/outside surfaces of the panel 1 are designed, the color cathode ray tube of the present invention suggests designing an optimal curvature structure of a shadow mask at first and designing an optimal curvature structure of an inside surface of a panel 1 having a flat outside surface with reference to the optimal curvature structure design of the shadow mask, for optimizing reproduction of a picture. FIG. 4 illustrates a curvature structure of a shadow mask in accordance with a preferred embodiment of the present invention shown with reference to a diagonal axis schematically, referring to which the optimized structure of the shadow mask will be explained.

Referring to FIG. 4, a geometrical structure of the shadow mask 5 may be represented with three coordinate axes, i.e., a long axis X-axis, a short axis Y-axis, and diagonal axis D-axis on a two dimensional plane. Different from the basic coordinate axes X-axis and Y-axis, the diagonal axis D-axis is set up for examining variation of curvature of the shadow mask 5. The geometrical structure of the shadow mask 5 may be represented with three coordinate axes, i.e., a long axis X-axis, a short axis Y-axis, and height axis Z-axis in a three dimensional space. An origin of the coordinate axes, i.e., the long axis X-axis, the short axis Y-axis, the diagonal axis D-axis, and height axis Z-axis is set at a center of the shadow mask 5. Ldm denotes a distance from the center of the shadow mask 5 to coordinates Xm and Ym within the two dimensional plane, where Xm, Ym, and Zm denote coordinates of a point on a three dimensional coordinate axes of the shadow mask 5.

Depending on a form of curvature applied, even if the shadow mask 5 has the same height to ends 5*a* of an effective surface, the shadow mask 5 may have different strength characteristics. That is, as explained, though the super arc curvature is favorable for a thermal deformation, the arc curvature is favorable for strength actually, which may be verified by experiment or structural analysis. According to this, instead of the super arc curvature employed in the related art, the arc curvature is employed to the shadow mask 5 of the present invention. Since the shadow mask 5 employs the arc curvature, a portion of sphere, the shadow mask 5 has the same radius of curvature on the same coordinate axis.

The curvature structure of the shadow mask 5 of the present invention will be explained in detail with reference to the employed curvature form of the shadow mask 5.

The curvature structure of the shadow mask 5 can be wholly explained by representing the height axis (Z-axis) coordinate with reference to the diagonal axis (D-axis) that contains the long axis (X-axis) and short axis (Y-axis). In the curvature structure with reference to the diagonal axis, Rdm is a radius of curvature of the diagonal axis, and, as explained, the radiuses Rdm of the curvatures at any points on the diagonal axis are the same regardless of the positions of the diagonal axis. As shown in FIG. 4, a coordinate Zm of the height axis of a point is the radius Rdm' of curvature of the diagonal axis at the center of the shadow mask 5 subtracted by a length 'A'.

$$Zm=Rdm'-A \tag{1}$$

The length 'A' in the equation (1) can be obtained from a geometrical relation between the radius of curvature Rdm" and a length 'B' at a point.

$$A=\sqrt{R_{dm}''^2-B} \tag{2}$$

Where, the length 'B' is the distance Ldm on the two dimensional plane, which may be defined by a geometrical relation of two dimensional coordinates Xm and Ym.

$$A=\sqrt{R_{dm}''^2-(X_m^2+Y_m^2)} \tag{3}$$

As explained, since Rdm, Rdm', and Rdm" in equations (1) to (3) are the same (Rdm=Rdm'=Rdm"), the curvature structure of the shadow mask 5 may be expressed as follows.

$$Z_m=R_{dm}-\sqrt{R_{dm}^2-(X_m^2+Y_m^2)} \tag{4}$$

There can be dispersion of the curvature structure of the shadow mask 5 depending on fabrication processes and deflection yokes. If it is assumed that 'α' is the dispersion, the curvature structure may be expressed as follows.

$$Z_m=R_{dm}-\sqrt{R_{dm}^2-(X_m^2+Y_m^2)}\pm\alpha \tag{4}$$

The dispersion 'α' may be defined by empirical equation, that is included to equation (5) to obtain an equation (6), below.

$$Z_m = R_{dm} - \sqrt{R_{dm}^2-(X_m^2+Y_m^2)} \pm \frac{\sqrt{X_m^2+Y_m^2}\times\left(L_{dme}-\sqrt{X_m^2+Y_m^2}\right)}{44.456L_{dme}} \tag{6}$$

In the meantime, in the curvature structure of the shadow mask 5, Ldme denotes a distance from the center of the shadow mask 5 to the end 5*a* of the effective surface in the diagonal axis direction, and Hdme denotes a height in the diagonal axis direction of the shadow mask 5, both of which are defined in advance when the shadow mask 5 is designed according to a specification of the cathode ray tube to be fabricated. Eventually, the radius Rdm of curvature that fixes a curvature of the shadow mask 5 can be fixed as the following equation (7) from the geometrical relation shown in FIG. 4.

$$R_{dm} = \frac{L_{dme}^2+H_{dme}^2}{2H_{dme}} \tag{7}$$

Once the distance Ldme is fixed and the radius Rdm of curvature is fixed therefrom, the curvature structure of the shadow mask 5 expressed in the equation (6) can be defined wholly. Because the curvature structure of the shadow mask 5 of the present invention employs a curvature form having a high strength characteristic, i.e., the arc curvature, basically, inclusive of the dispersion, the structural strength is optimized, and the curvature structure of the shadow mask 5 of the present invention can also provide a high strength to the super arc curvature.

Figure 5A:
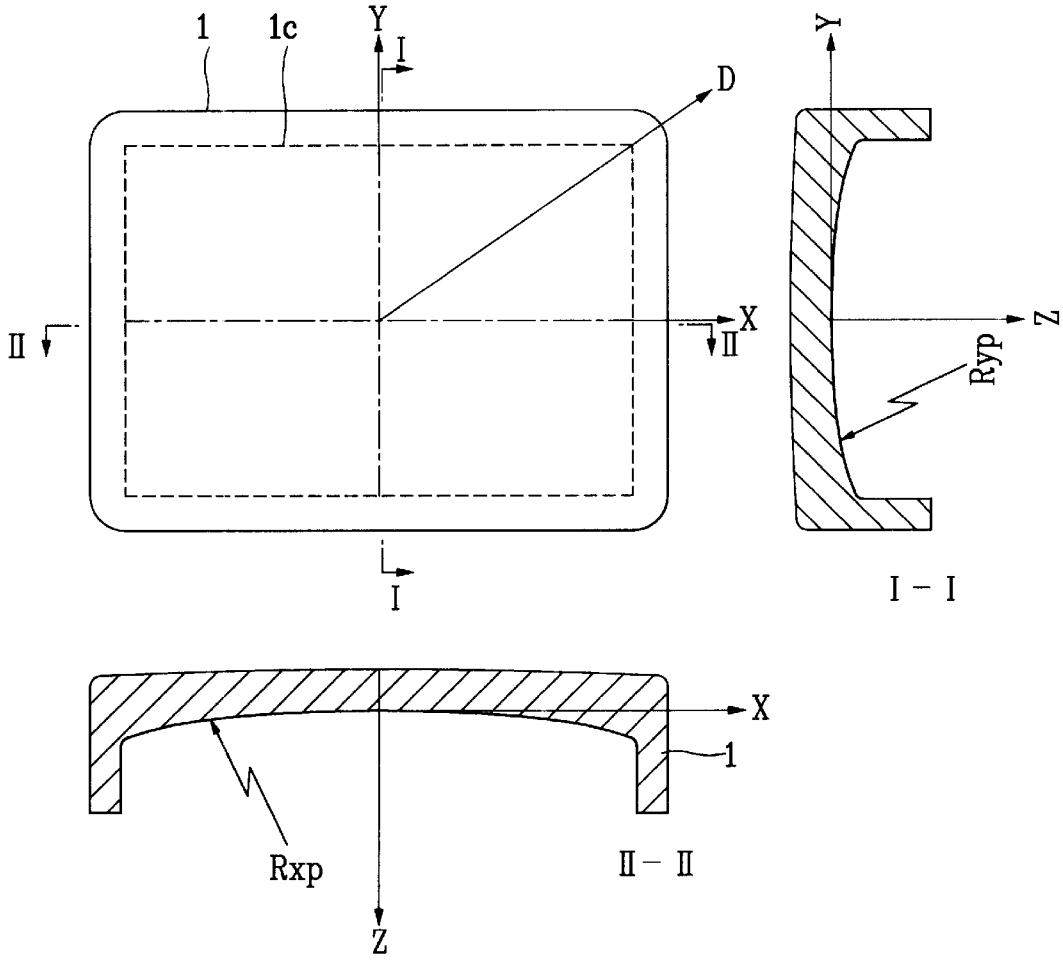
FIG. 5A illustrates a curvature structure of an inside surface of a panel in accordance with a preferred embodiment of the present invention shown with reference to a long axis, and a short axis, schematically; and, FIG. 5B illustrates a curvature structure of an inside surface of a panel in accordance with a preferred embodiment of the present invention shown with reference to a diagonal axis, schematically.
Figure 5B:
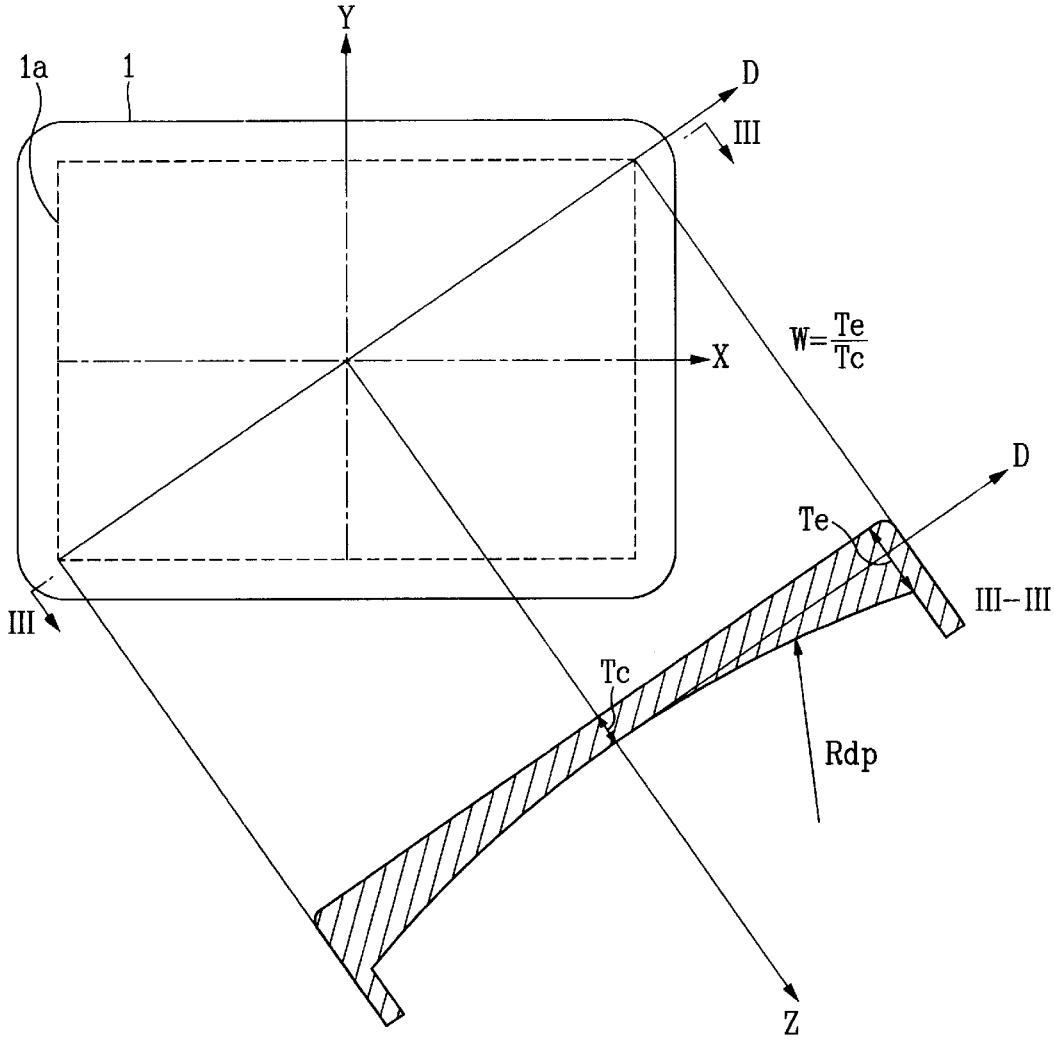

In the meantime, the geometrical characteristic between the shadow mask 5 and the panel 1 is required to be taken into consideration for securing a picture quality and a color purity of the color cathode ray tube. To meet the geometrical characteristics, the relation of the curvature structures of the shadow mask 5 and the inside surface of the panel 1 is required to be optimized. Therefore, the inside surface structure of the panel 1 of the present invention is required to be designed suitable to the optimized curvature structure of the shadow mask 5. FIG. 5A illustrates a curvature structure of an inside surface of a panel in accordance with a preferred embodiment of the present invention shown with reference to a long axis, and a short axis schematically, and FIG. 5B illustrates a curvature structure of an inside surface of a panel in accordance with a preferred embodiment of the present invention shown with reference to a diagonal axis schematically, referring to which the optimized curvature structure of the inside surface of the panel according to the curvature structure of the shadow mask will be explained.

In the two dimensional planar and three dimensional spatial coordinates, as coordinate axes of the panel 1 are the same with coordinate axes of the shadow mask 5, detailed explanation of which will be omitted. In the set up coordinate axes, Rxp, Ryp, and Rdp denote radiuses of curvatures of the inside surface of the panel 1 in a long axis, short axis, and diagonal axis directions, respectively. As shown in FIG. 5B, Tc denotes a center thickness of the panel 1, and Te denotes a thickness of the panel 1 at the end of the effective surface 1*c*. With regard to a basic curvature structure of the panel 1, in the related art cathode ray tube having the panel 1 with a curved outside surface, the inside surface of the panel 1 is designed to have a fully spherical curvature structure in which the radius Rxp of curvature in the long axis direction and the radius Ryp of curvature in the short axis direction are the same. However, in the cathode ray tube of the present invention that has a fully flat or a flatness close to the fully flat outside surface of the panel 1, owing to design, the inside surface of the panel 1 has basically different curvature structures in which the radius Rxp of curvature in the long axis direction and the radius Ryp of curvature in the short axis direction differ. When, a ratio of the thickness Tc to the thickness Te (called as a wedge ratio) is represented with 'W', the radius Rx of curvature in the long axis (X-axis) direction can be expressed as follows.

$$R_{xp}=(A\cdot W+B)\cdot R_{dm}(A=-0.217,\ 1.607<B<2.446) \tag{8}$$

The radius of curvature in the short axis (Y-axis) direction can be expressed as follows.

$$R_{yp}=(C\cdot W+D)\cdot R_{dm}(C=-0.074,\ 0.799<D<1.227) \quad (9)$$

As can be known from the equations (8) and (9), the radiuses Rxp and Ryp of curvatures in the long axis and short axis directions are set up with reference to the radius Rdm of curvature for reflecting the optimized geometrical characteristic, i.e., the optimized curvature structure of the shadow mask 5. Therefore, the parameters "A, B, C, and D" are fixed by structural analyses based on the foregoing conditions, i.e., the radius of curvature Rdm and the wedge ratio 'W', and based on which the radiuses Rxp and Ryp of curvatures in the long axis and the short axis directions are optimized with respect to the radius of curvature of the inside surface of the panel 1. The parameters "E, and F" are fixed by structural analyses based on the wedge ratio 'W' and the radiuses Rxp and Ryp of curvatures in the long axis and the short axis directions as follows.

$$R_{dp}=\frac{(4\cdot R_{xp}+3\cdot R_{yp})}{(E\cdot W+F)}(E=0.011,\ F=6.655) \quad (10)$$

As shown in the equation (10), the radius of curvature Rdp in the diagonal direction contains the radiuses Rxp and Ryp of curvatures in the long axis direction and in the short axis direction, and defined as a relation between the radiuses Rxp and Ryp. In conclusion, the curvature of the inside surface of the panel 1 of the present invention can be expressed by the radius Rdp of curvature in the diagonal direction, actually.

In the meantime, a wedge ratio below 1.5 renders a relatively thin peripheral thickness of the panel 1, which makes a strength against a vacuum inside of the cathode ray tube poor, and, opposite to this, a value of the equation (1) over 2.5 renders a too thick peripheral thickness of the panel 1, which makes a thermal conductivity poor, to cause a thermal stress owing to a temperature difference between the inside surface and the outside surface of the panel 1, to cause breakage during fabrication or operation. Therefore, in designing the curvature of the inside surface of the panel 1, it is preferable that the wedge ratio 'W' falls on a range greater than 1.5 but small than 2.5.

As has been explained, design of the shadow mask 5 is optimized for providing a high strength, and a curvature of an inside surface of a panel 1 is designed to meet a geometrical relation with the shadow mask 5. Therefore, the color cathode ray tube of the present invention can provide a high structure strength to the shadow mask while the color cathode ray tube maintains an appropriate picture quality. Moreover, the high structural strength improves a vibration damping characteristic of the shadow mask, and prevents the shadow mask from deteriorating a color reproducibility. The improved structural strength minimizes deformation of the shadow mask caused by an external load.

It will be apparent to those skilled in the art that various modifications and variations can be made in the color cathode ray tube of the present invention without departing from the spirit or scope of the invention. Thus, it is intended that the present invention cover the modifications and variations of this invention provided they come within the scope of the appended claims and their equivalents.

What is claimed is:

1. A color cathode ray tube comprising:

a panel having a substantially flat outside surface and an inside surface with a curvature; and, a shadow mask at rear of the panel formed to have a curvature, wherein, when Rxp denotes a radius of curvature of the inside surface of the panel in a long axis direction, Ryp denotes a radius of curvature of the inside surface of the panel in a short axis direction, Rdm denotes a radius of curvature of the shadow mask in a diagonal axis direction, and 'W' denotes a ratio of a thickness of an end portion of an effective surface of the panel to a thickness of a center portion of the panel, the radius Rxp of curvature of the inside surface of the panel in the long axis direction, and the radius Ryp of curvature of the inside surface of the panel in the short axis direction can be respectively expressed as follows;

$$R_{xp}=(A\cdot W+B)\cdot R_{dm}(A=-0.217,\ 1.607<B<2.446)$$

$$R_{yp}=(C\cdot W+D)\cdot R_{dm}(C=-0.074,\ 0.799<D<1.227).$$

2. A color cathode ray tube as claimed in claim 1, wherein, when Rdp denotes the radius of curvature of the inside surface of the panel in the diagonal axis direction, the Rdp can be expressed as follows, $$R_{dp}=\frac{(4\cdot R_{xp}+3\cdot R_{yp})}{(E\cdot W+F)}(E=0.011,\ F=6.655).$$

3. A color cathode ray tube as claimed in claim 1, wherein the ratio of a thickness of an end portion of an effective surface of the panel to a thickness of a center portion of the panel 'W' falls within a range of $1.4<W<2.5$.

4. A color cathode ray tube as claimed in claim 1, wherein, when Ldme denotes a distance from a center of the shadow mask to an end of the effective surface of the shadow mask in the diagonal axis direction, and Hdme denotes a height at the end of the shadow mask in the diagonal axis direction, the radius of curvature Rdm of the shadow mask in the diagonal axis direction can be expressed as follows.

$$R_{dm}=\frac{L_{dme}^2+H_{dme}^2}{2H_{dme}}.$$

5. A color cathode ray tube as claimed in claim 1, wherein, when Xm denotes a coordinate on the long axis of the shadow mask, Ym denotes a coordinate on the short axis of the shadow mask, and Zm denotes a coordinate on a height axis of the shadow mask, the curvature of the shadow mask can be expressed as follows.

$$Z_m=R_{dm}-\sqrt{R_{dm}^2-(X_m^2+Y_m^2)}.$$

6. A color cathode ray tube as claimed in claim 5, wherein, when 'α' denotes a dispersion come from a fabrication process and a deflection yoke, a curvature structure of the shadow mask can be expressed as follows, taking the dispersion into account.

$$Z_m=R_{dm}-\sqrt{R_{dm}^2-(X_m^2+Y_m^2)}\pm\alpha,$$

where, $$\alpha=\frac{\sqrt{X_m^2+Y_m^2}\times\left(L_{dme}-\sqrt{X_m^2+Y_m^2}\right)}{44.456L_{dme}}.$$

* * * * *